United States Patent [19]

Shimura

[11] Patent Number: 4,530,760

[45] Date of Patent: Jul. 23, 1985

[54] WATER SURFACE FLOTAGE SUCTIONING APPARATUS

[76] Inventor: Masuo Shimura, 47, Ohashi-machi 2-chome, Minami-ku, Yokohama-shi, Kanagawa-ken, Japan

[21] Appl. No.: 452,976

[22] Filed: Dec. 17, 1982

[30] Foreign Application Priority Data

Jan. 11, 1982 [JP] Japan ..... 57-2570

[51] Int. Cl.[3] ..... B01D 12/00; E02B 15/00

[52] U.S. Cl. ..... 210/242.3; 210/923

[58] Field of Search ..... 210/242.1, 242.2, 242.3, 210/923

[56] References Cited

U.S. PATENT DOCUMENTS

| | | | |
|---|---|---|---|
| 3,561,601 | 2/1971 | McNeely | 210/242.1 |
| 4,006,086 | 2/1977 | Tsunoi | 210/776 |
| 4,046,691 | 9/1977 | Irons | 210/923 |
| 4,059,526 | 11/1977 | Middelbeek | 210/923 |
| 4,100,072 | 7/1978 | Uchida et al. | 210/923 |
| 4,111,811 | 9/1978 | Fukuda et al. | 210/923 |
| 4,136,030 | 1/1979 | Seike et al. | 210/923 |
| 4,191,650 | 4/1980 | Muneta | 210/242.3 |
| 4,305,830 | 12/1981 | Shimura | 210/242.3 |

FOREIGN PATENT DOCUMENTS

| | | | |
|---|---|---|---|
| 0008982 | 1/1978 | Japan | 210/242.3 |

*Primary Examiner*—Richard V. Fisher
*Assistant Examiner*—Sharon T. Cohen
*Attorney, Agent, or Firm*—James C. Wray

[57] ABSTRACT

The present invention relates to an apparatus for suctioning and collecting flotage on the water surface. The apparatus consists of a water guide passage to collect surface flotage, a guide plate floating below the water surface in said water guide passage, a rearward facing means to eject a pressurized water current, and an additional means similarly ejecting a pressurized water current to check and suppress currents which hinder the effect of the water flowing in said water guide passage.

22 Claims, 17 Drawing Figures

WATER SURFACE FLOTAGE SUCTIONING APPARATUS

BACKGROUND OF THE INVENTION

The present invention relates to an apparatus for suctioning and collecting water surface flotage including oil, pollutants, floating debris and the like. Various improvements have been made on apparatus of this kind, but it is difficult to suction and collect only the flotage on the water surface, and the general interest centers on how to minimize the volume of water entrained with a suctioned flotage.

A flotage suctioning apparatus is disclosed by the present inventor in U.S. Pat. No. 4,305,830. In that patent, the apparatus is equipped with an intake port to guide the flotage backward. Being stationary, that intake port cannot satisfactorily guide the surface flotage when the waves are high. U.S. Pat. Nos. 4,006,082, 4,100,072 and 4,111,811 describe other flotage collection apparatus.

SUMMARY OF THE INVENTION

The present invention provides a water surface flotage suctioning apparatus which has a main body, a water guide passage installed in the main body, a guide plate provided in the water guide passage so as to be floating at a specific depth below the surface of water current which flows in the guide passage. A backward-facing means attached to said guide plate serves to eject a pressurized water current toward the back of the water passage. Another means serves to eject a pressurized water current to counter, check and suppress back currents which hinder the flow of the water current in the water guide passage. Thus, even under conditions of high waves, the flotage can be efficiently suctioned.

The present invention provides a water surface flotage suctioning apparatus with a pressurized water current ejecting means located in the water guide passage such that it is free to move and bob up and down relative to the water guide passage. Thus, even under the conditions of high waves, a constant depth beneath the water surface can be maintained, and the surface current can be worked with a powerful suction.

The present invention also provides a water surface flotage suctioning apparatus with a means for suppressing any flow which hinders the water surface flow caused by the main pressurized water current ejecting means and located in the water guide passage as another means integrated to the main pressurized water current ejecting means and serving to eject a pressurized water current forward and downward and/or another or an alternate means located downstream of the main pressurized water current ejecting means serves to eject a pressurized water current forward and downward and/or rearward and downward.

Other objects and features of the present invention are apparent in the following description of examples of its embodiments.

BRIEF DESCRIPTION OF THE DRAWINGS

FIG. 1 is a diagram illustrating the relationship between the first and second back current suppressing means shown in FIGS. 1-6.

DESCRIPTION OF THE PREFEERED EMBODIMENTS

Figure 1:
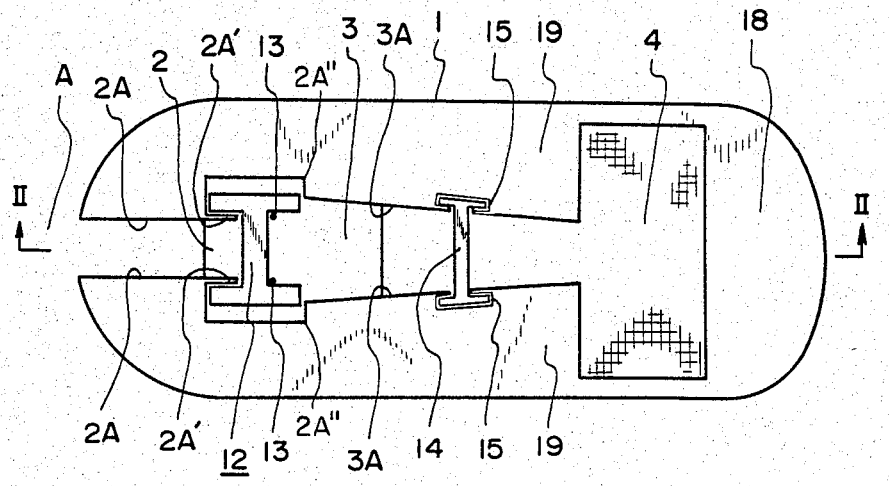
FIG. 1 is a plan view of water surface flotage suctioning apparatus according to the present invention.
Figure 2:
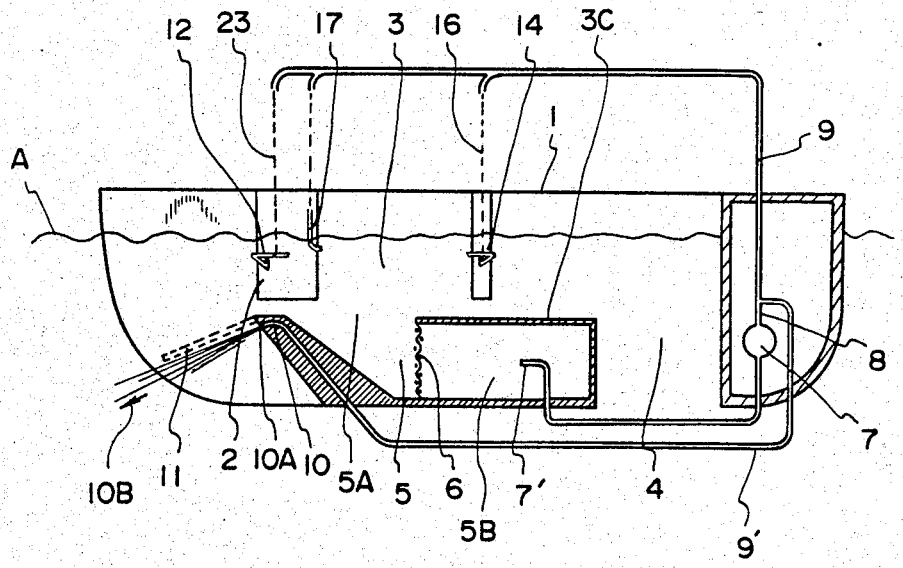
FIG. 2 is a longitudinal sectional view taken on line II—II of FIG. 1.

FIGS. 1 and 2 illustrate applications of the present invention in a hull of a water craft. Hull 1 floats on water surface A. Hull 1 has a water guide port 2 in the bow portion to suction surface flotage. Water guide passage 3 guides the flotage from port 2 toward the stern. Side walls 2A and 3A extend along both sides of port 2 and passage 3. The bottom of passage 3 is formed by a mid-floor 3C, which extends in the longitudinal direction of the hull 1. At the stern of hull 1, a tank 4 collects the flotage carried through passage 3. The bottom of said tank 4 opens outward to discharge water. In the mid-floor 3C opens a suction port 5A of a suction passage 5 to divert the water in said passage 3 rearward and downward. Passage 5 extends rearward and downward from port 5A, and passing below the mid-floor 3C, it reaches a chamber 5B enclosed by the partition walls of the bottom wall of the mid-floor 3C, downward extensions of both side walls 3A of said passage 3, the top face of the bottom wall of the hull and the tank 4. Chamber 5B is open only at the front. The opening of said chamber is equipped with a filter 6. Suction pipe 7' installed within said chamber is connected to the pump 7. Exhaust port 8 of pump 7 leads via the branch pipes 9 and 9' to each water current ejection port. For drawing convenience's sake, the piping is shown outside the hull, but it goes without saying that, in reality, the piping is installed inside the hull.

In the water near the entrance to the water guide passage 3, there is a floating-type water current ejection means 12, which floats at a specified depth. Being restricted in crosswise movements in the horizontal plane by the extensions 2A' of side walls 2A and both supports 13 in the water guide passage, ejection means 12 can bob up and down in accordance with wave motions. The extensions 2A' and supports 13, together with recesses 2A", form vertically and horizontally extending grooves in which ejection means 12 can move freely up and down in response to wave action. A bow water current ejection means 10 has a plurality of water ejection ports 10A at the forward end of hull 1 below the water guide port 2. Alternately or in addition, a downward inclined plate 11 (indicated by a dotted line) is connected to both side walls 2A of the water guide port 2 and to a bottom wall of the water guide passage may be attached to hull 1 below the entrance to the water guide passage. In the latter case, the water current ejection means 10 at the bow may be unnecessary.

At an appropriate position in the water guide passage 3, a back current suppressing means 14 floats at a specified depth in the water. Being fitted into a recesses 15 of side walls 3A, on both sides, suppression means 14 can bob up and down in accordance with wave motions. The recesses 15 are shown in FIG. 1 and extend both longitudinally and vertically. Back current suppressing means 17 may be installed at the top of both sides of the water ejection means 12, or they may be separately installed. Stern portion 18 houses the propeller, steering gear and pump. Surface flotage collected in the tank 4 is transferred to a collected oil tank in midships portion 19.

Figure 3:
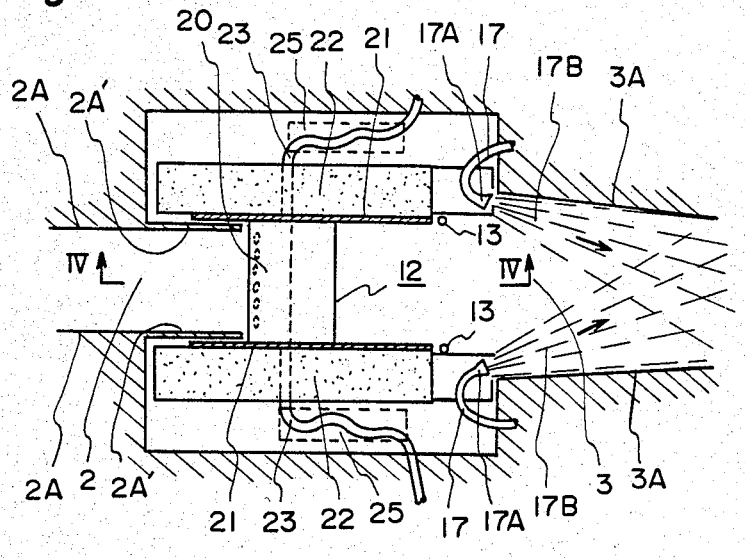
FIG. 3 is an enlarged detail plan view of the water current ejecting means shown in FIG. 1, showing a first back current suppressing means.
Figure 4:
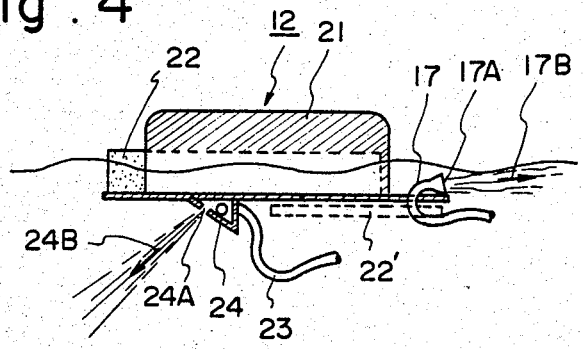
FIG. 4 is a longitudinal sectional view taken on line IV—IV of FIG. 3.
Figure 5:
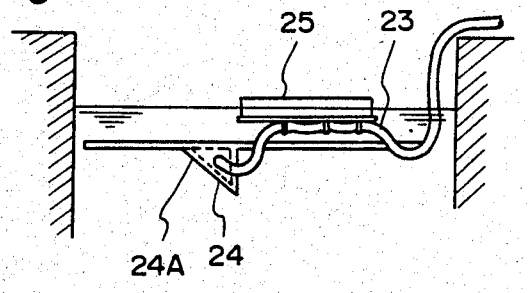
FIG. 5 is a detail view of the hose-floating means used in the apparatus shown in FIGS. 1 and 2.
Figure 6:
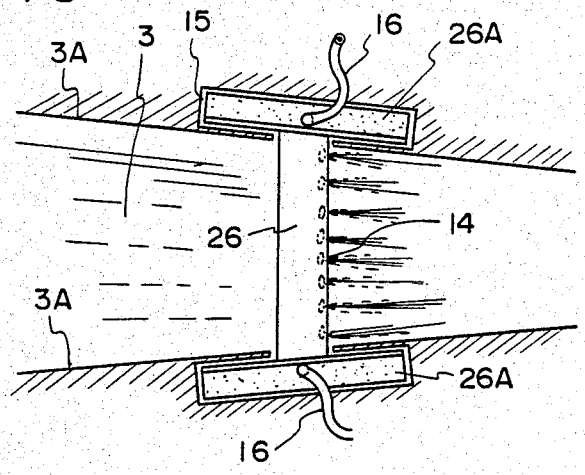
FIG. 6 is an enlarged detail plan view of a second back current suppressing means shown in FIG. 1.

Referring to FIGS. 3, 4 and 5, the floating-type water current ejection means 12 has a water guide pipe 24, approximately triangular in section, which is attached at the forward end. Hoses 23 are connected to the branch pipe 9 (FIG. 2) and to the water guide pipe 24. A water guide plate 20 has upright streamlining plates 21 on both sides. Buoyant members 22 adjoin streamlining plates 21. Buoyant members 25 support said hoses 23. Water guide pipe 24 has a plurality of water ejection ports 24A. When the buoyant members 22 alone cannot provide ample buoyancy or good balance, additional buoyant members 22' for adjusting buoyancy are provided beneath the water guide plate 20. Hose 23, connected to the water guide pipe 24, as indicated in FIG. 5, is suspended from the buoyant member 25. The hose floats near the water surface, with one end of the hose connected to the water guide pipe 24. The other end of the hose is connected via the branch pipe 9 to the exhaust port 8 of the suction pump 7 (as shown in FIG. 2). Styrene foam is appropriate as the material for the buoyant members.

The water, driven by pump 7 and reaching the water guide pipe 24 via port 8, pipe 9 and hose 23, is discharged in a downward torrent out of the water ejection ports 24A and generally forms a water sheet 24B.

The water ejection means 10, at the bow in the embodiment shown in FIG. 2, provides a plurality of water ejection ports 10A over the full width of the water guide port 2 at the bow below said port 2. The water depth in the water guide passage 3 is set large so that high waves can be accommodated. To prevent water suction below the water ejection means 12, there is provided at the port 2 the bow water ejection means 10, whereby water invasion from beneath the hull can be prevented by combination of a water sheet 10B formed by said means 10 and a water sheet 24B formed by floating-type water current ejection means 12. Instead of using ejection means 10, a downward inclined plate 11 connected to both side walls 2A and to the bottom wall of the water guide passage may be attached to the hull below the entrance to the water guide passage, whereby water invasion from outside is prevented by directing the water sheet 24B on plate 11.

Referring to FIGS. 2, 3 and 4, an example of the first back current suppressing means 17 is described. Suppressing means 17, when it is to be coupled with ejection means 12, can be effectively installed such that a flow is generated from the side wall of the water guide passage 3 in a rearward and central direction. Water driven by the pump 7 flows via port 8, branch pipe 9 and eddy suppression means 17 to the water ejection ports 17A. Water is discharged rearward and horizontally over the water surface and just beneath the surface fanwise as a discharge current 17B, which suppresses the back current from the tank 4. Said means 17 may be provided separately. Under whatever installation, three methods are possible. Namely, a method of floating said means at a specified depth of water, floating said means up or down in accordance with wave motions and ejecting a water current horizontally over the water surface and at a depth just beneath the surface; a method of setting the ejection ports 17A on the water surface and ejecting water currents 17B onto the water surface down slantwise; and a method of setting ports 17A below the water surface and ejecting water currents 17B upward slantwise onto the water surface.

Referring to FIGS. 6, 7, 8 and 9, an example of the second back current suppressing means 14 is described. Suppressing means 14 is analogous in form and function to means 12. Thus, suppressing means 14 consists of a water guide plate 26 supported on both sides by respective buoyant members 26A. An approximately triangular water guide pipe 27 is provided beneath said plate 26. A plurality of discharge ports 27A open downward and rearward in pipe 27. Hose 16 supplies pressurized water to said pipe 27. The water guide plate 26 in suppressing means 14 is also located at a specified depth of water.

The differences between the means 14 and means 12 are as follows:

1. Current discharge directions are opposite to each other.
2. Means 14 is smaller and lighter than means 12.
3. In the means 14, the buoyant member areas on both sides are minimized for structural reasons of the hull and, accordingly, the reduction in the buoyant member area is offset by an increased thickness to secure buoyancy balance.
4. In the means 12, hoses 23 are loose and float below the surface. In the means 14, for reasons of space, hoses 16 are suspended from above, pass through buoyant members 26A on both sides, and are connected to the water guide pipe 27.

Both sides of said means 14 fit into the longitudinal recesses 15 provided on both walls 3A of the water guide passage 3 so that means 14 floats up and down in accordance with wave motions.

Pump 7 flows water via port 8, pipe 9 and pipe 16 to water guide pipe 27. Water is discharged as a torrent out of ports 27A in the direction of the bottom 3C of the passage 3, and, forming a water sheet 27B, it suppresses back current from the tank 4.

Figure 8:
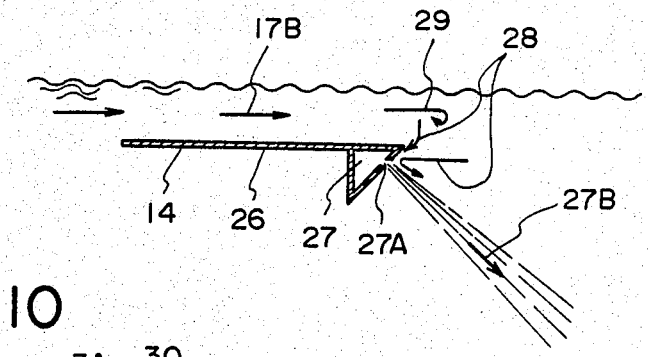
FIGS. 8 and 9 are diagrams illustrating the currents generated by the second back current suppressing means.

In FIG. 8, a current 27B suddenly discharged out of port 27A generates a fast suction current 28 toward the port 27A. The surface current 17B reaching the surface above the port 27A is affected by said suction current 28, and, swirling in an eddy current 29, the water loses its linear velocity. (In the case of the means 12, agreement between the direction of surface flow and that of suction flow causes an acceleration of the surface flow.)

Figure 9:
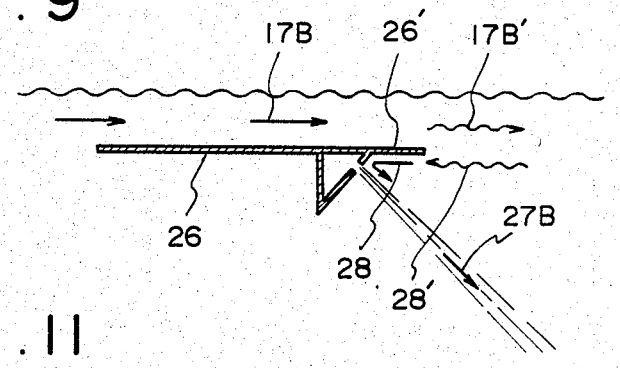

FIG. 9 illustrates a means to prevent velocity loss of the surface current 17B. If the water guide plate 26 is extended forward, the suction current 28' near the tip of the extension 26' will not be very strong and its influence on the surface current 17B will be just such as to lower the flow velocity. (If the extension 26' is made longer, there will be no change in the velocity of the surface current 17B.) Slowdown of the surface current 17B after passage over the water guide plate 26 will be rather favorable. In the case of collecting the oil floating on the seas, the suction process may be fast, but slowdown of the current just before reaching the tank will help smooth collection of the oil.

Figure 10:
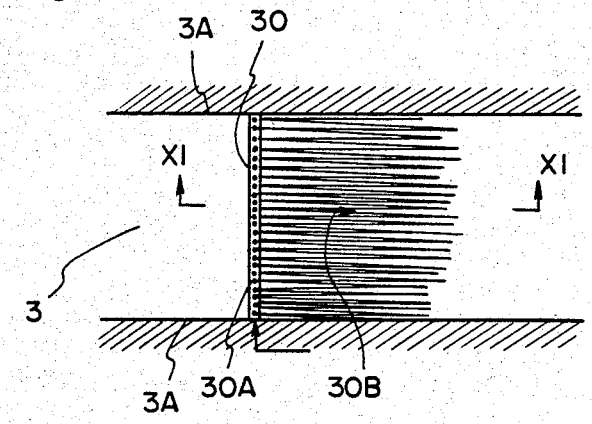
FIG. 10 is a plan view of the back current suppressing means located at the bottom of the passage.
Figure 7:
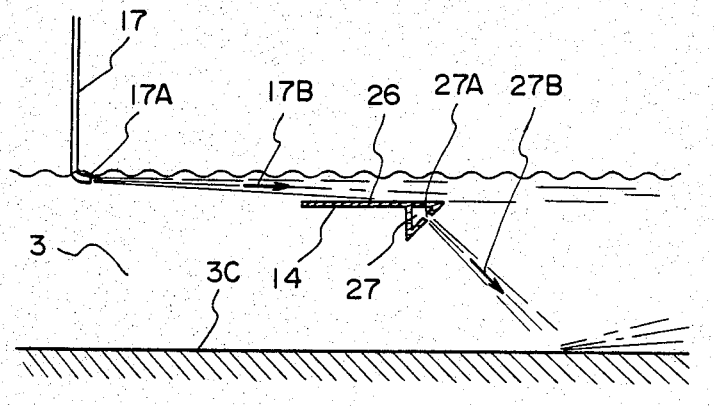
Figure 11:
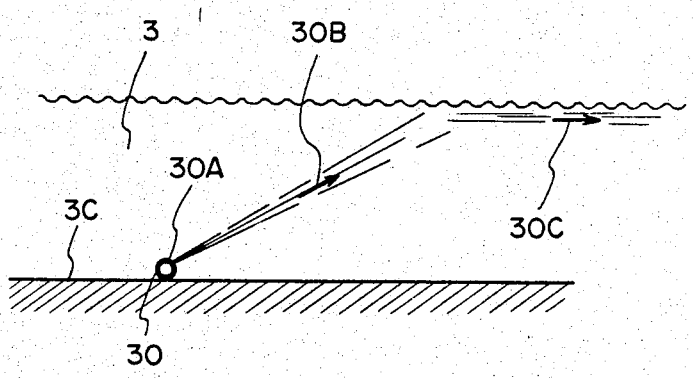
FIG. 11 is a longitudinal sectional view taken on line XI—XI of FIG. 10.

In addition to the above, there is a back current suppressing means 30. Suppressing means 30 is described referring to an example in FIGS. 10 and 11. Water ejection pipe 30 with a plurality of discharge ports 30A is installed on the full width of the bottom 3C of the passage 3. Discharge ports 30A are so arranged that a water current can be ejected rearward and upward slantwise. The current, forming a water sheet 30B, suppresses the back current from the tank 4, generating a swift current 30C on the water surface. Therefore, if the tank is located nearby, and, if it is narrow, a strong eddy current will develop on the water surface of the tank. This is undesirable, and adoption of the means 30 should be decided depending on the full structure.

Figure 12:
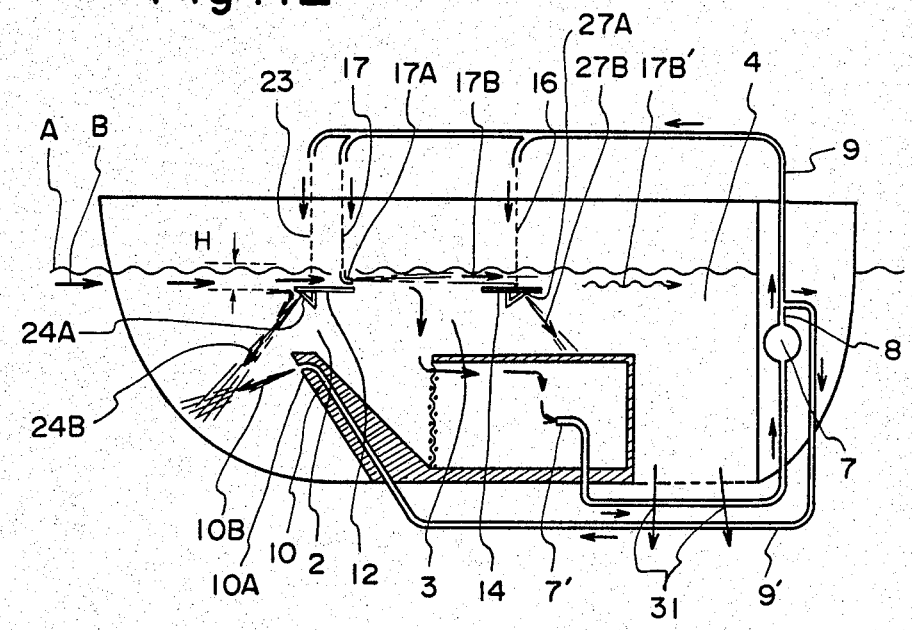
FIG. 12 is a view similar to FIG. 2, showing water currents when the pump is driven.
Figure 13:
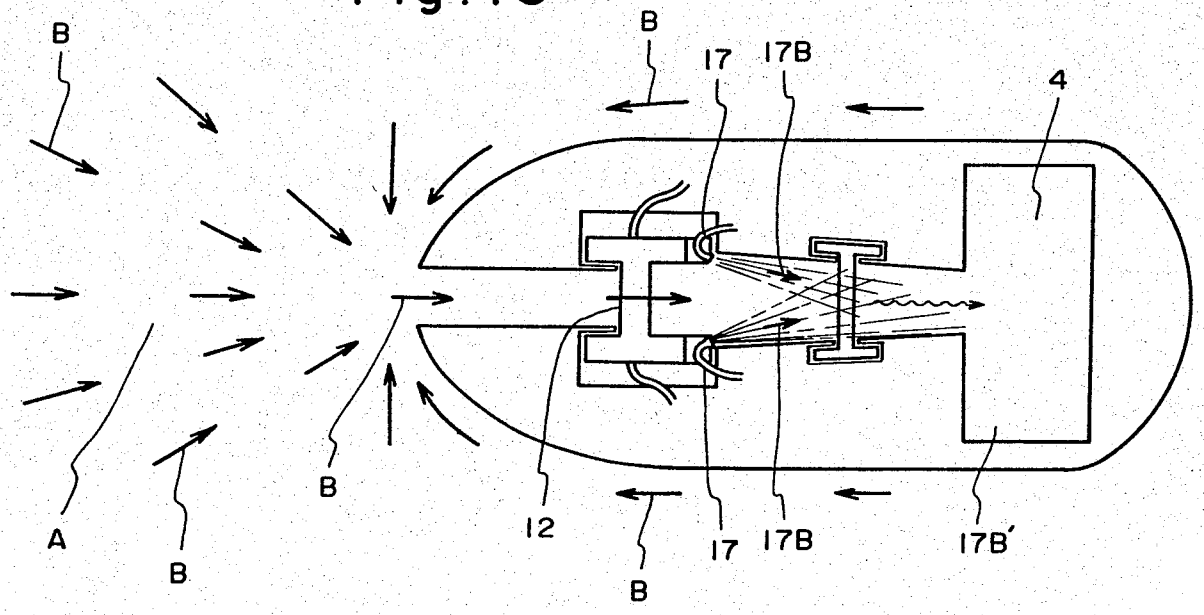
FIG. 13 is a plan view corresponding to FIG. 12.

FIG. 12 is a sectional view, and FIG. 13 is a plan view showing a suction current B generated on the water surface ahead of the hull and a movement of water in the water guide passage when the pump 7 is driven to discharge the currents 24B, 10B, 17B and 27B respectively out of the floating-type water current ejection means 12, the bow current water ejection means 10, the back current suppressing means 17 and the back current suppressing means 14.

Discharge ports 24A, 10A and 27A are substantially identical and have small diameters. Discharge currents 24B, 10B, 27B are swift and, forming a sheet-like water barrier, they prevent water invasion from outside. Port 24A discharges water downward, and port 10A discharges water horizontally or slightly downward. Ports 24A and 10A are arranged such that the discharge currents 24B and 10B may intersect each other ahead of the water guide port 2 under the water area enclosed by side walls 2A, whereby suction of water ahead of and below port 2 can be prevented. Port 27A discharges water downward, and, forming a sheet-like water film of discharge current 27B between port 27A and bottom 3C of the water guide passage 3, suppresses back current from the tank 4.

Port 17A is singular or plural; it discharges a horizontal, rearward current 17B fanwise on the surface of the passage 3 and just beneath the water, thereby suppressing the back current from tank 4 and, at the same time, sending the collected flotage to tank 4. Due to the effects of discharge currents described above, the passage of the suction current generated by the action of pump 7 is confined to the top surface of plate 20 of means 12. Plate 20, moving up and down with the motions of waves, serves to maintain the water depth above plate 20 nearly constant. Accordingly, a constant suction current B develops from the water surface A ahead of and on the sides of the bow.

The surface flotage on the seas, floating on the suction current B, reaches the water surface in the water guide passage 3 and is slowly collected on the water surface of the tank 4 by the action of the discharge current 17B from the back current suppressing means 17 and the slow surface current 17B'. When the collected substance is oil, the oil collected in the tank is by appropriate means transferred to the collected oil tank 19 (FIG. 1). The water entrained in the tank 4 will go out as an exhaust current 31 through the bottom opening of the tank 4.

The series of operations described above will be most effective when the hull is at least at rest or is being propelled at "dead slow ahead". When the hull is being propelled, the propulsion can be countered by providing several rows of discharge ports 24A and by stacking several rows of water flow one over another of the current 24B, thereby strengthening the water film of discharge current 24B.

Figure 14:
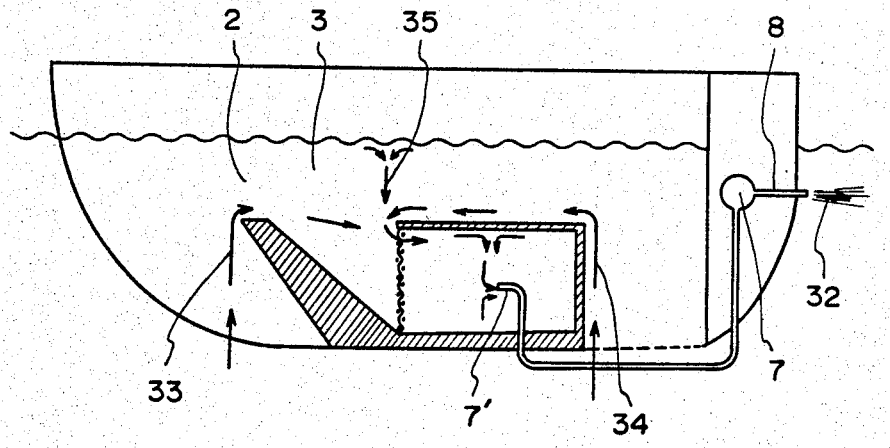
FIG. 14 is a diagram showing water currents when generated only by pump suction.

Referring to FIGS. 12 and 14, the effects of discharge currents 24B, 10B and 27B are mathematically explained. In FIG. 14, pump 7 is driven to draw water in at suction 7' and to discharge the exhaust 32 out of the port 8. Suction water drawn to the suction 7' is composed of a suction current 33 drawn out of the water ahead of and just beneath the port 2, a suction current 34 sucked out of the water at the end of and just beneath the passage 3, and a suction current 35, i.e., suctioned-in current drawn from the surface of the passage 3.

From the following data, the velocities of the suction currents 33 and 34 are determined.

| | |
|---|---|
| Pump capacity (flow rates of 33, 34 and 35 are assumed each about 70 $m^3/h$) | 200 $m^3/h$ |
| of port 2 | 1 m |
| End width of passage 3 | 1 m |

Flow width of suction currents 33, 34 is equal to the width of the passage and flow thickness ranges from 0.05 m to 0.1 m. Current thickness is assumed as 0.05 m.

The following formula is employed for calculation:

$$\frac{70\ m^3/h \div (1\ m \times 0.05\ m)}{3600\ sec} = 0.39\ m/sec \qquad \text{Formula 1}$$

In FIG. 12 the flow velocities of the discharge currents 24B, 10B and 27B are calculated from the following data:

| | |
|---|---|
| Pump capacity | 200 $m^3/h$ |
| Water volume discharged from each of ports 24A, 10A, 27A | 36 $m^3/h$ per one port |
| Total number of each of the ports | 200 to every three ports |
| Diameter of each port | 0.003 m per one port |
| Width of water guide pipes 24, 10, 27 | 1 m |
| Width of port 2 and passage 3 | 1 m |

If the conditions are the same for ejection means 12, ejection means 10 and suppression means 14, calculations are made for convenience's sake about the means 12.

Areas of one port 24*A* . . .
$(0.003 \div 2)^2 \times 3.14 = 0.000007\ m^2$
Total area of the ports 24*A* . . .
$0.000007\ m^2 \times 200 = 0.0014\ m^2$
Flow velocity of the current 24*B* is found from the following formula -continued $$\frac{36\ m^3/h \div 0.0014\ m^2}{3600\ sec} = 7.1\ m/sec \qquad \text{Formula 2}$$

From comparison between Formulas 1 and 2, it is obvious that the velocities of Formula 2 of discharges 24B, 10B and 27B are, by far, faster than those of Formula 1 of suctions 33 and 34 and the discharged water film is strong enough to suppress the suction current; a wide difference will remain the same, even allowing for possible errors in the allocation of flow rates among suctions 33, 34 and 35.

Figure 15:
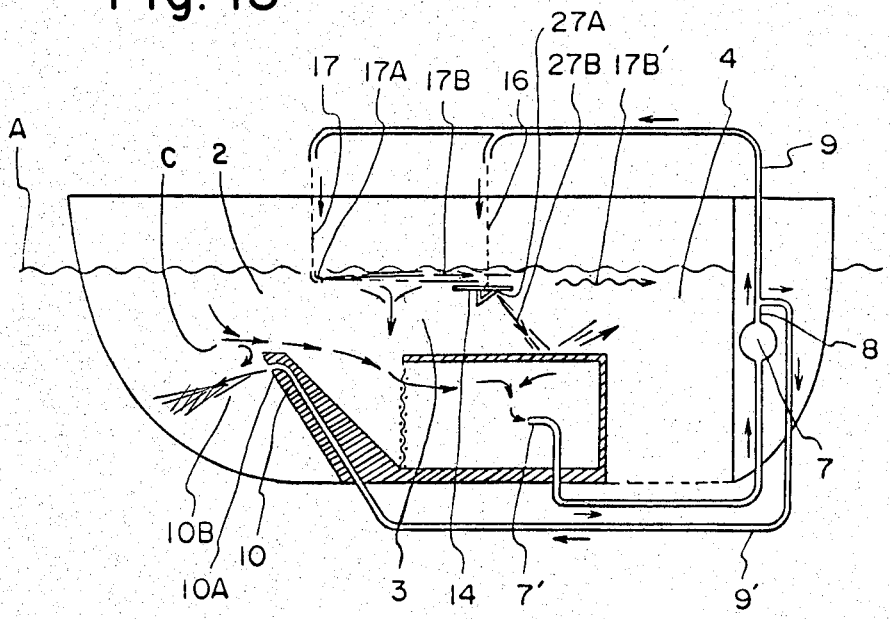
FIG. 15 is a diagram showing current conversion.

Now, referring to FIGS. 12, 14 and 15, the effect of the discharge 10B, 27B, 17B and 24B can be explained. FIG. 14 shows a situation where, for the sake of illustration, discharges 10B, 27B and 24B have been removed. In this case, current 33 moves upwardly, and countercurrents 34 and 35 move as illustrated. In the absence of discharges 10B, 27B and 24B, no current is generated in the bow below the water surface.

The current 33 shown in FIG. 14 is converted into current C as shown in FIG. 15 by the discharge 10B. The counter current 34 is suppressed by the discharge 27B and the counter current 35 is suppressed by the discharge 17B. Without more, however, a desired current below the water surface is not generated.

FIG. 12 shows how the current C is converted into the current B. The velocity of current B will be accelerated by the discharge 17B. To convert current C into current B it is necessary to intersect the discharge 24B with the discharge 10B.

In FIG. 12, the distance H represents the distance between the guide plate 12 and the water surface. It is preferable that this distance is small since the current B would flow faster when the distance is small.

Figure 16:
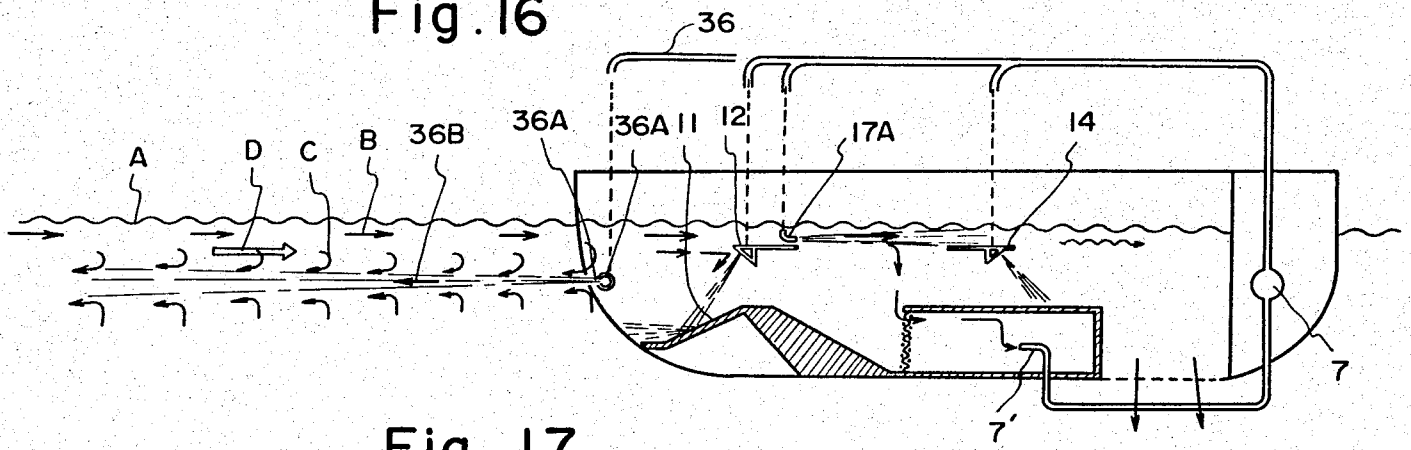
FIG. 16 is a similar view to FIG. 12 which shows additional embodiments, which may be used with the embodiment of FIG. 12.

FIG. 16 illustrates an example of a means being provided for increasing the suction power.

Water ejection pipe 36, adjustable to wave conditions, is additionally installed at the forward end of the water guide port of the bow, a single or plural discharge ports 36A are provided in pipe 36. Thus, a discharge current 36B is ejected into the water nearly in horizontal direction against the direction of the suction current B in an arbitrary direction, say, from the forward of bow to the lateral direction. The discharge current 36B need not be in a water sheet, but may be ejected linearly. In this example, the first object is to break the balance between the flotage and the surface tension by creating a disturbance beneath the water on a distant area of surface. The second object is to accelerate the suction current. Namely, a suction current C develops around a strong current 36B. The suction current C converges to flow D. Flow D is added to the suction current B. Moreover, the suction by the pump 7 concentrates on the water surface layer containing the flotage within the scope of suction current C. In consequence, the suction becomes extremely strong with an enhanced efficiency of collecting the flotage. An increased power of the discharge current 36B will facilitate quick suction and collection of oil, debris, etc. located far ahead of the bow.

There is an example of using a downward inclined plate 11 instead of the bow discharge means 10 (FIG. 12). In this example, the suction current on the surface comes, as indicated in FIG. 13, from every direction. Therefore, if the flotage in a specific direction only is to be collected, the following means to restrict the suction direction will be added.

Figure 17:
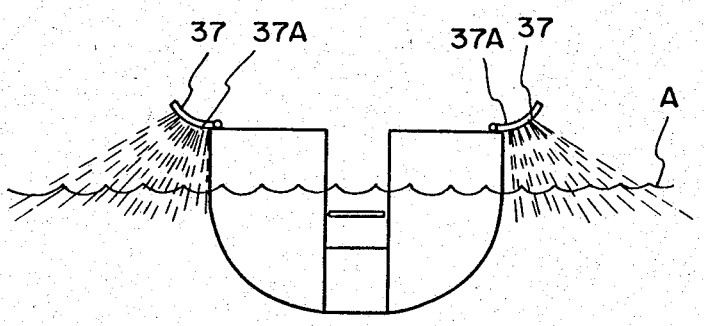
FIG. 17 shows an embodiment in which a water sprinkler is installed on both sides of the hull.

FIG. 17 is a section view of an embodiment of this suction restricting means 37.

Means 37 consists of a pipe 37 with a plurality of discharge ports 37A; one end of said pipe 37 is closed, and water is sprayed from the discharge port 37A. Such pipes 37 are juttingly provided at both sides of the bow. The intended object is attained by merely spraying water on the water surface A from said port 37A lightly and continuously Water sprayed on the surface A causes a water disturbance which prevents occurrence of a suction current from the side of ship and thereby limits the suction current to the forward and oblique forward direction, and, accordingly, restricts the sucked direction of the surface flotage.

The description herein is related to an application of the present invention to a ship, but the application will not be thus limited. For example, it may be applied as a fixed apparatus in a pond. Further, it may be applied in wide range.

The present invention brings about the following benefits:

1. Even when the waves are high, the suction can be concentrated on the water surface layer containing the flotage, and, accordingly, the foltage suction efficiency is remarkable.
2. Since the water depth for location of the water guide passage can be freely selected in the designing stage, there are few restrictions in design.
3. With no limitation of the kind of flotage to be handled, the invention is available for all sorts of flotage.
4. The surface flotage around the shore, mooring and pier, which has been hard to eliminate by the conventional cleaning method, can be effectively collected.

While the invention has been described with reference to specific embodiments, modifications and variations of the invention within the broader scope of the invention will be apparent to those skilled in the art. The scope of the invention is defined in the following claims.

I claim:

1. Water surface flotage suctioning apparatus comprising:

A main body, means defining a water guide passage connected to the main body, means defining a water-facing water guide port connected to a first end of the passage, a tank mounted in the main body and connected to an end of the passage remote from the guide port, a water guide plate located at a specified depth of water in said water guide passage, water ejection means provided adjacent said water guide plate and for ejecting a pressurized water current rearward in the passage, and suppression means mounted in the passage for suppressing counter currents which hinder flow of the water current in said water guide passage, buoyant members provided on both ends of the water guide plate, and vertically and horizontally extending grooves in side walls of the passage adjacent the guide plate wherein said buoyant members fit into the vertically and longitudinally extending grooves on the side wall of said passage, while said plate is vertically movable.

2. Apparatus of claim 1 wherein said water ejection means for ejecting a pressurized water current rearward in said passage comprises means for ejecting the current from the side wall of the passage.

3. Apparatus of claim 1 wherein said suppression means comprises a pipe provided beneath said water guide plate and means for ejecting a water current forward and downward of the passage from the pipe.

4. Apparatus of claim 1 wherein said suppression means comprises means for ejecting a water current rearward and downward in said passage at the rear of said plate.

5. Apparatus of claim 1 wherein said suppression means comprises means which is provided at the bottom of said passage for ejecting water current ejected rearward from a bottom of said passage.

6. Apparatus of claim 1 wherein said suppression means comprises means for ejecting a water current into the water forward of said passage and in a horizontal direction below the water.

7. Water flotage collecting apparatus comprising means defining water guide passage having first and second ends, means defining a water guide inlet port at the first end and a collection tank at the second end, a water guide plate mounted movably in the water guide passage, support means for supporting the water guide plate at a predetermined depth in water in the water guide passage and flow means for controlling water flow over the guide plate, the plate further comprising water current ejection means mounted beneath the guide and having openings for ejecting water downward and forward from the water ejection means.

8. The apparatus of claim 7 wherein the support means comprises floating means connected to the water guide plate for floating and supporting the water guide plate at a constant depth below a surface of water in the passage.

9. The apparatus of claim 8 wherein the passage has generally vertical side walls and wherein the floating means comprises buoyant floats connected to opposite ends of the plate adjacent side walls of the passage.

10. The apparatus of claim 9 wherein the side walls have vertically and longitudinally extending recesses and wherein the floats fit within and move vertically within the recesses.

11. The apparatus of claim 7 further comprising back current suppression means mounted in the passageway.

12. The apparatus of claim 11 wherein the back current suppression means comprises a second plate and means to support the plate below a water surface in the passage and means for ejecting water downward and rearward from said plate.

13. The apparatus of claim 11 wherein the suppression means comprises means mounted beneath a water surface and adjacent sides of the guide plate for ejecting water upward, inward and rearward in the passage.

14. The apparatus of claim 7 wherein the flow means comprises means mounted beneath a surface of water in the passage and rearward of the plate for ejecting water rearward in the passage.

15. The apparatus of claim 7 further comprising means mounted below a water surface ejecting water forwardly and horizontally to promote rearward surface flow toward the port.

16. The apparatus of claim 7 further comprising pipes extending laterally above a water surface on opposite sides of the passageway for spraying water on the water surface and interrupting surface flow.

17. Water surface suctioning and collecting apparatus comprising a hull, a receiving tank mounted in the hull near a stern thereof, an oil holding chamber mounted in the hull in communication with the receiving tank, means defining a surface water inlet port mounted in the hull near a bow thereof, means defining a water passageway mounted in the hull between the inlet port and the receiving tank, a water guide plate floating and moving vertically, mounted in the passageway in horizontal alignment beneath a surface of the water at a predetermined depth, buoyant floats connected to opposite sides of the plate near walls of the passageway for supporting the plate beneath the water surface, flow means mounted in the passage rearward of the plate for flowing water rearward in the passageway and inducing flow into the port, over the plate, through the passageway and into the receiving tank, and back current suppression means mounted in the passageway for flowing water rearward therein to suppress back currents in the passageway whereby flotage is drawn into the port above the plate and through the passageway into the tank.

18. Water surface flotage suctioning apparatus comprising:

a main body, means defining a water guide passage connected to the main body, a water guide plate located in said water guide passage and held therein at a specified depth of water being movable vertically corresponding to the motions of the water-surface, a water current changing means located beneath the water guide passage and comprising a downward and forward inclined plate so as to get a desired water current, a water ejection means mounted on the water guide plate for ejecting a pressurized water slantwise forward and downward along the water guide plate, a pump means for leading water into the water guide passage and supplying a pressurized water to the water ejection means, and a back current suppressing means for ejecting the pressurized water rearward in a horizontal direction below the water.

19. Apparatus of claim 18 further comprising floating means provided on both ends of the water guide plate.

20. Water surface flotage suctioning apparatus comprising:

a ship, means defining a water guide passage connected to the ship, first water guide plate located in said water guide passage and held therein at a specified depth of water being movable vertically corresponding to the motions of the water surface, a water current changing means located beneath the water guide passage and comprising a downward and forward inclined plate so as to get a desired water current, a water ejection means mounted on the water guide plate for ejecting a pressurized water slantwise forward and downward along the water guide plate, a pump means for leading water into the water guide passage and supplying a pressurized water to the water ejection means, first back current suppressing means for ejecting the pressurized water rearward in a horizontal direction below the water, a receiving tank mounted in the hull near a stern thereof, a chamber located between the water current changing means and the tank, second water guide plate located at the rear of the first guide water plate and held at a specified depth of water being movable vertically corresponding to the motions of the water surface, and second back current suppressing means mounted on the first water guide plate for ejecting the pressurized water slantwise rearward, downward and toward top surface of the chamber.

21. Apparatus of claim 20 wherein said suppression means comprises means for ejecting a water current rearward and downward in said passage at the rear of said plate.

22. Apparatus of claim 20 wherein said suppression means comprises means, which is provided at bottom of said passage, for ejecting a water current ejected rearward and upward.

* * * * *

UNITED STATES PATENT OFFICE

CERTIFICATE OF CORRECTION

PATENT NO. : 4,530,760

DATED : July 23, 1985

INVENTOR(S) : Masuo Shimura

It is certified that error appears in the above-identified patent and that said Letters Patent are hereby corrected as shown below:

Claim 20, line 33 (Col. 11, last line), please change "first" to --second--.

Signed and Sealed this

*Eleventh* Day of *February 1986*

[SEAL]

*Attest:*

DONALD J. QUIGG

*Attesting Officer*

*Commissioner of Patents and Trademarks*